US010267124B2

(12) United States Patent
O'Donnell et al.

(10) Patent No.: US 10,267,124 B2
(45) Date of Patent: Apr. 23, 2019

(54) SUBSEA LIVE HYDROCARBON FLUID RETRIEVAL SYSTEM AND METHOD

(71) Applicant: CHEVRON U.S.A. INC., San Ramon, CA (US)

(72) Inventors: Thomas Edward O'Donnell, Houston, TX (US); David Hugh Fraser, Houston, TX (US); Christa Soutullo Musgrove, Houston, TX (US); Katherine Patricia Papageorge, Houston, TX (US); Peter Phuong Tran, Houston, TX (US); Zachary Wade Lampkin, Houston, TX (US); David John Taghehchian, Houston, TX (US); Ryan Frederic Keller, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/837,978

(22) Filed: Dec. 11, 2017

(65) Prior Publication Data

US 2018/0163519 A1 Jun. 14, 2018

Related U.S. Application Data

(60) Provisional application No. 62/433,568, filed on Dec. 13, 2016.

(51) Int. Cl.

| | |
|---|---|
| ***E21B 43/01*** | (2006.01) |
| ***B63G 8/00*** | (2006.01) |
| ***E02B 15/00*** | (2006.01) |
| ***E21B 43/017*** | (2006.01) |

(52) U.S. Cl.

CPC ..... *E21B 43/0122* (2013.01); *B63G 8/001* (2013.01); *E02B 15/00* (2013.01); *E21B 43/017* (2013.01); *B63G 2008/005* (2013.01); *E02B 2015/005* (2013.01)

(58) Field of Classification Search

CPC ..... E21B 43/0122; E21B 43/01; B63G 8/00; B63G 8/001; B63G 2008/005; E02B 15/00; E02B 2015/005

See application file for complete search history.

(56) References Cited

U.S. PATENT DOCUMENTS

| | | | |
|---|---|---|---|
| 6,637,514 | B1 | 10/2003 | Donald et al. |
| 7,111,687 | B2 | 9/2006 | Donald et al. |
| 7,363,982 | B2 | 4/2008 | Hopper |
| 8,109,223 | B2 | 2/2012 | Jamieson |

(Continued)

FOREIGN PATENT DOCUMENTS

| | | | |
|---|---|---|---|
| EP | 2379404 | B1 | 10/2011 |
| GB | 2520709 | A * | 6/2015 |

(Continued)

*Primary Examiner* — Sunil Singh

(74) *Attorney, Agent, or Firm* — Karen R. DiDomenicis

(57) ABSTRACT

Disclosed is a subsea live hydrocarbon fluid retrieval system and method. The system and method include the ability to depressurize the fluid while enacting controlled venting of the gas entrained in the fluid during a controlled ascent to the surface from the seabed. The system and method do not require ancillary equipment at surface for management of gas or pressure. The fluid arrives at surface with minimal gas and pressure.

16 Claims, 3 Drawing Sheets

(56) References Cited

U.S. PATENT DOCUMENTS

| | | | | |
|---|---|---|---|---|
| 8,197,577 | B2 | 6/2012 | Couch | |
| 2005/0025574 | A1 | 2/2005 | Lazes | |
| 2006/0237194 | A1 | 10/2006 | Donald et al. | |
| 2008/0035327 | A1 | 2/2008 | Fowkes | |
| 2010/0038324 | A1 | 2/2010 | Couch | |
| 2010/0059221 | A1 | 3/2010 | Vannuffelen et al. | |
| 2011/0005765 | A1 | 1/2011 | Cumming et al. | |
| 2011/0042323 | A1 | 2/2011 | Sullivan, II | |
| 2012/0051840 | A1 | 3/2012 | Hatton | |
| 2015/0315879 | A1* | 11/2015 | Williams | E21B 41/0007 166/339 |

FOREIGN PATENT DOCUMENTS

| | | | |
|---|---|---|---|
| WO | 2008087156 | A1 | 7/2008 |
| WO | 2009070034 | A3 | 6/2009 |
| WO | 2010106499 | A1 | 9/2010 |
| WO | 2010109243 | A2 | 9/2010 |
| WO | 2011114170 | A1 | 9/2011 |
| WO | 2011114172 | A1 | 9/2011 |
| WO | 2011147853 | A1 | 12/2011 |

* cited by examiner

SUBSEA LIVE HYDROCARBON FLUID RETRIEVAL SYSTEM AND METHOD

CROSS-REFERENCE TO RELATED APPLICATION

The present application claims priority to U.S. Provisional Patent Application No. 62/433,568, filed on Dec. 27, 2016, entitled "Subsea Small Volume, Live Hydrocarbon Fluid Retrieval System And Method", the contents of which are hereby incorporated herein by reference in its entirety.

FIELD OF THE INVENTION

This invention relates to a subsea hydrocarbon fluid retrieval system and method. In particular, this invention relates to subsea hydrocarbon fluid retrieval system and methods designed for live hydrocarbon fluids, recovered to surface from seabed having equalized to ambient pressure and/or retained pressure ambient at collection point.

BACKGROUND OF THE INVENTION

Live hydrocarbon fluids may naturally seep from the seabed, leak from subsea production infrastructure located at the seabed, or flow from subsea well infrastructure at and/or below the seabed. To retrieve live hydrocarbon fluids from shallow water, riser collection systems have been used. In the riser collection system, a riser system or other conduit (hard or flexible) is connected to direct a hydrocarbon source from the seabed to the surface for removal. These systems have primarily focused on shallow water (less than 500 feet) applications and are typically used with low gas content fluids. These systems would be prohibitively expensive for small volumes of hydrocarbon fluids and would be impractical where retrieval occurs at multiple collection points. In addition, these collection systems are not suited for long term operations in remote, deep water fields. In deep water, a passively managed and operated riser collection system is not practical due to the large volume of gas released by the fluid as it ascends and separates within the riser. The rapidly expanding gas inside the riser would require an active gas and pressure management system to be connected to the top of the riser. Further, dynamic forces on the conduit through the water column in operation and during installation contribute to the complexity of the system in deep water applications. Deep water active riser systems exist, but require constant support by a vessel, at high cost, making this solution prohibitively expensive for relatively small volume collection.

Alternatively, subsea sampling systems have been used to retrieve pressurized samples of live hydrocarbon fluids from depth to the surface for laboratory testing. These systems are generally sized for recovery of very small volume (<10 L) samples. Such subsea sampling systems are typically filled with a live hydrocarbon fluid sample at depth where ambient pressure is high, and where the fluids of the sample are pressurized in excess of the ambient pressure. The intent of these systems is to recover the live hydrocarbon fluids to surface at its source's resident pressure (the pressure of the source could be at or even high above the ambient seawater hydrostatic pressure by hundreds to tens of thousands of psi). Trapped pressure of this sort has personnel safety risk implications. Also, the ability to empty the sample and reuse the equipment offshore is limited as it has high internal pressure and would require special depressurization equipment onboard. The methods of these sampling systems are limited to very small volumes and do not inherently allow depressurization before bringing hydrocarbon near personnel. Its primary purpose is to contain the sample and isolate it.

To address the collection and recovery of live hydrocarbon fluids, it would be desirable to provide a system and method for the retrieval of live hydrocarbon fluids from a subsea collection point with the ability to, retrieve fluid to surface in pressurized state, inject collected fluids into existing subsea infrastructure, and/or depressurize the fluid while enacting controlled venting of the gas entrained in the fluid during ascent to the surface from the seabed.

SUMMARY OF THE INVENTION

According to one embodiment, a subsea live hydrocarbon fluid retrieval system and method are disclosed. According to one embodiment, the retrieval system includes a subsea storage and transfer rack (SSTR), a containment device (CT), and a remotely operated vehicle (ROV) Collection Skid (RCS). The system and method include the ability to depressurize the fluid while enacting controlled venting of the gas entrained in the fluid during ascent to the surface from the seabed. The system and method do not require ancillary equipment at surface for management of gas or pressure. The fluid arrives at surface with minimal gas and pressure.

Live hydrocarbon fluids may seep from the seabed. In one embodiment, to collect these fluids, a seabed containment system is installed on the seabed. In one embodiment, the seabed containment system comprises a single or a plurality of independent CT which may be installed on the seabed over locations of live hydrocarbon fluids seeping from the seabed. The hydrocarbon fluids then collect in the plurality of CT. In one embodiment, the capacity of the retrieval system may be about 400 liters; however, the capacity of the system can vary from 20 to 3000 liters using one or several isolatable collection circuits.

In one embodiment, the collected fluids are retrieved on an intermittent or regular basis by a surface vessel of opportunity. In one embodiment, a SSTR is used to retrieve the collected fluids. In one embodiment, the SSTR is deployed from the vessel to the seabed via crane. In order to be filled with the collected fluids, the SSTR must have a source pressure. In one embodiment, an auxiliary pump skid attached to a work class ROV facilitates the retrieval operation. The pump skid pumps live hydrocarbon fluids from the CT and into the SSTR through hydraulic hoses (also known as flying leads). After retrieval, the SSTR then transits the fluids as required for subsea reinjection or recovery to surface.

BRIEF DESCRIPTION OF THE DRAWINGS

The description is presented with reference to the accompanying figures in which.

DETAILED DESCRIPTION OF THE INVENTION

Figure 1:
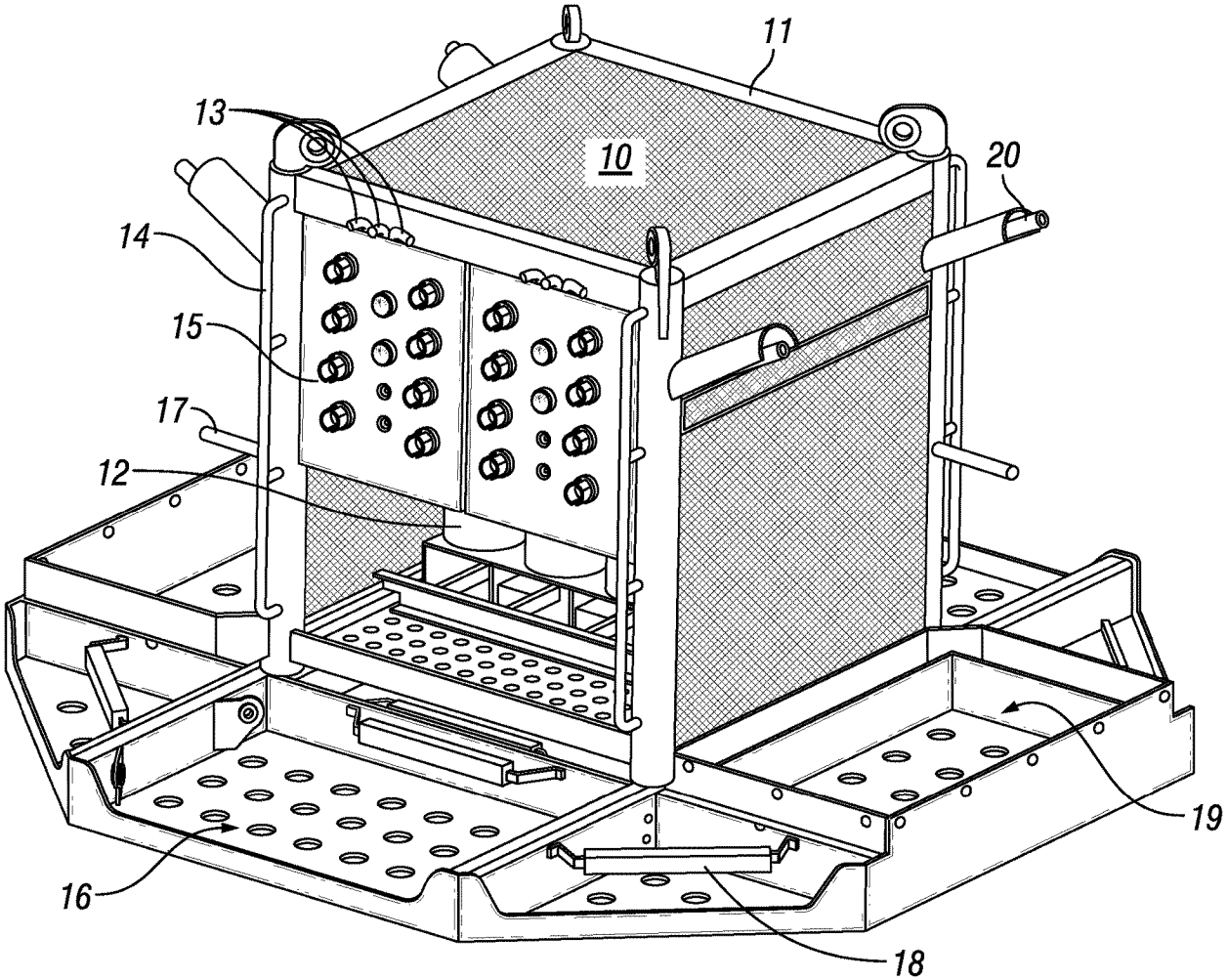
FIG. 1 illustrates one embodiment of the subsea storage and transfer rack (SSTR).

FIG. 1 illustrates one embodiment of a subsea storage and transfer rack (SSTR) 10. The SSTR 10 is an assembly used to transfer the hydrocarbons collected from a seabed containment system to the surface. In one embodiment, the SSTR 10 includes the following components: a frame 11, at least one accumulator 12, at least one gas outlet vent 13, at least one remotely operated vehicle (ROV) grab bar 14, at least one ROV control panel 15, a SSTR mudmat 16, a SSTR mudmat locking latch 17, at least one anode 18, at least one flying lead (hydraulic hoses) storage basket 19, at least one flying lead storage and management system 20.

In one embodiment, the frame 11 of the SSTR 10 is a designed frame that houses eight 52 gallon accumulators 12 with associated independent circuits. The number of accumulators 12 and the size of the accumulator may vary. The piston type accumulators 12 are used to store or transit hydrocarbons. The frame 11 is designed to minimize seabed penetration when the SSTR 10 is landed on the sea floor. The frame 11 is equipped with SSTR mudmat 16 to minimize seabed penetration and to provide stability when the SSTR 10 is accessed by the ROV. The SSTR mudmat 16 may be integrated or independent pieces. The frame 11 is also designed to provide complete protection of all components that make up the fluid transfer circuit. Also, grating is installed on the sides not containing the ROV control panel 15 to protect the accumulators 12 and associated hydraulic circuitry. The frame 11 design allows access to all components for ease of service offshore.

Each accumulator 12 will include a dedicated ROV control panel 15, and the necessary plumbing required for fluid transfer and gas venting operations. Each ROV control panel 15 will be equipped with a ROV grab bar 14 mounted to the SSTR 10 to help the ROV fix its position relative to the SSTR 10 during operations.

The SSTR 10 will also be equipped with anodes 18 specified for the application and its intended service life for cathodic protection during use subsea.

Each ROV control panel 15 will consist of subsea control valves rated for the design working pressure of the system. The panel will include hotstab receptacles as part of each fluid transfer circuit. Pressure monitoring will be provided by gauges/instrumentation installed within the specific fluid circuits. All hydraulic plumbing from the ROV control panel 15 to the accumulator 12 is securely fastened to the SSTR 10 frame 11 for protection.

Figure 2:
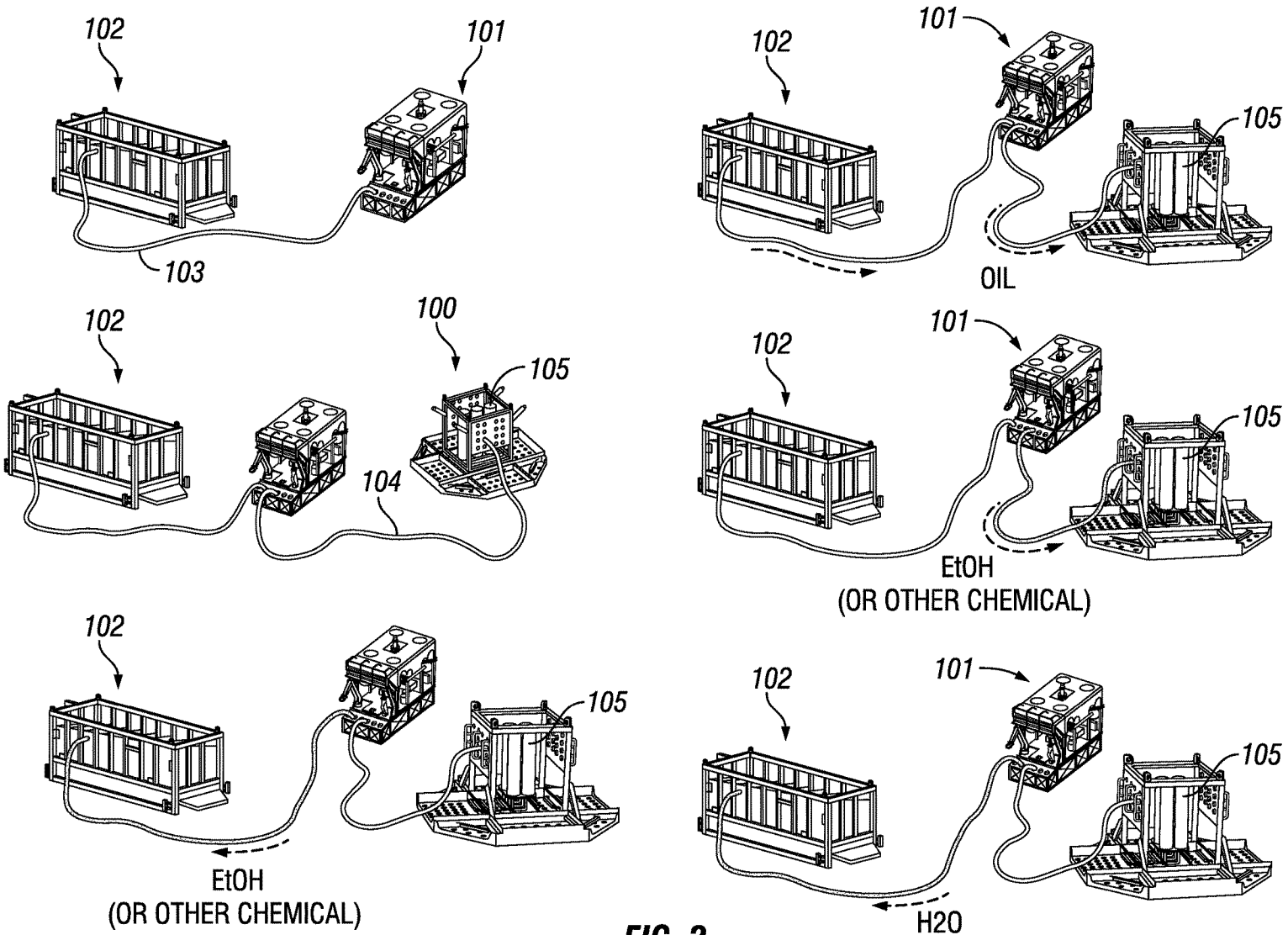
FIG. 2 illustrates one embodiment of the operation of the retrieval system.

FIG. 2 illustrates one embodiment of the retrieval system and the operation of the SSTR 100. According to one embodiment, the retrieval system includes a SSTR 100, a CT 102, and a ROV Collection Skid (RCS) 101. The system may also include flow meter (not pictured).

In order to operate the SSTR 100, a vessel with a sufficient crane is needed. In order to operate the SSTR 100 on the seabed in deep water, a work class ROV with an RCS 101 or other sufficient subsea pump package will be required. In order to operate the SSTR 100 on the seabed in shallow water, operations could utilize a diving spread with appropriate pumps and divers in place of an ROV.

To fill the SSTR 100 accumulators 105, a differential pressure must be applied to overcome the movement resistance of the piston and its back pressure inlet check valves. In one embodiment, this differential pressure could be accomplished by utilizing a pump skid such as an RCS to create the pressure needs to fill the SSTR 100. In another embodiment, this differential pressure could be accomplished by collecting from a point where the source pressure is high enough to allow pressurized flow, such as a dedicated intervention point on subsea production and/or wellhead infrastructure, or a sealing connection on a leak point or the seabed to capture unintentional or natural flow.

In one embodiment, a CT 102 is installed on the seabed over potential locations of live hydrocarbon fluids seeping from the seabed. As shown in the first step of FIG. 2, retrieval system operation includes connecting a first flying lead 103 from RCS 101 to CT 102. Next, as shown in the second step, a second flying lead 104 is connected from RCS 101 to SSTR 100. Next, as shown in the third step, RCS 101 pumps ethanol via flying lead 103 to CT 102. Next, as shown in the fourth step, RCS 101 pumps ethanol via flying lead 104 to SSTR 100. Next, as shown in the fifth step, hydrocarbon fluids will be pumped from CT 102 to SSTR 100. Next, as shown in the sixth step, RCS 101 pumps ethanol via flying lead 104 to SSTR 100. Next, as shown in the seventh step, RCS 101 pumps ethanol via flying lead 103 to CT 102. Finally, as shown in the eighth step, seawater will be used to flush the tubing of the CT 102. In one embodiment, fluid volumes pumped via the RCS 101 can be measured via pump timing, counting pump strokes, and/or with the incorporation of flowmeter(s) into the RCS circuitry.

After filling, the SSTR 100 may be recovered to surface under ROV surveillance. When transiting to the surface, the SSTR 100 can recover hydrocarbons by at least two methods: either venting gaseous breakout, as the pressure drops on retrieval ascent, or by retrieving the contents to surface under pressure.

In one embodiment, the SSTR has the facilities (the piping, configuration, and procedural controls) to allow for a controlled venting of entrained gas during ascent. In this embodiment, the SSTR uses the expanding gases in the contained fluid to move the piston within the accumulator during ascent. In this embodiment, the hydrocarbon side of the accumulator piston is hydraulically isolated from the environment. The backside, or seawater side, of the piston is in direct hydraulic communication with the environment. This communication with the environment allows internal accumulator pressure, on both sides of the piston, to remain equalized with ambient pressure. During recovery operations, as the accumulator ascends from the seabed toward the surface, ambient pressure decreases with a decrease in depth. As depth and ambient pressure decrease and the accumulator internal pressure equalizes with the change in depth, entrained gas in the hydrocarbon fluid will evolve out of the fluid and begin to expand. As ascent continues, and as ambient pressure continues to decrease, the volume of free gas on the hydrocarbon side of the piston will increase, as the gas volume increases and accumulator internal pressure equalizes with ambient pressure, the accumulator piston will move incrementally and displace seawater from the backside of the accumulator to maintain pressure equilibrium between the accumulator and the ambient environment. This process of gas evolution and expansion, pressure equalization, and seawater displacement continues through the ascent until the volume of free gas equals the original volume of seawater fill on the backside of the piston. At that point, the piston will have been stroked completely and all seawater volume displaced from the accumulator to the environment. Inside the accumulator a free gas cap will form over the hydrocarbon fluid and the internal pressure of the accumulator will no longer equalize with external ambient pressure as depth decreases. The rate of gas evolution, piston movement, seawater displacement, and accumulator pressure management are controlled by ascent speed and the hydraulic circuitry.

Ascent speed and accumulator volume fill levels are governed by the hydrocarbon fluid Gas Oil Ratio (GOR). In other embodiments, GOR, if not known, can be determined in advance of conducting gas venting retrievals to surface and without retrieving pressurized fluid samples to surface. In this embodiment, the contained fluid energy is used to create its own expansion space within an accumulator. The SSTR has the ability to vent the gas to environment, but also has the capability to isolate internal fluids and gas at any pressure less than subsea ambient.

During vented ascent, there will be hold points at various water depths in order to allow for gas fluid separation inside the accumulator and to control the velocity of vented gas that has broken out of solution, reducing spill risk through fluid carryover in the gas. A combination of ascents and descents in the water column can be used for varying embodiments to manage gas volumes in the accumulator(s) and venting velocities. Fluid fill volumes at the seabed can be varied to accommodate retrieval of higher and lower GOR hydrocarbon fluids within the same seabed infrastructure and/or from natural seepages or flows. In this embodiment, fluids can be retrieved from the seafloor to the surface pressurized, without seawater displacements, without a free gas cap, and without fluid treatment; or, in conjunction with any combination of these operations. Prior to subsea deployment, the accumulators can be charged with chemical fluids, gasses, and other inhibiting or treatment fluids at the surface for transport to seabed and use during operations.

The accumulators can be used in combination or singularly to accomplish fluid carriage from surface, fluid treatment of adjacent or parallel accumulators, fluid treatment of containment devices, fluid transfer to and from adjacent accumulators, fluid transfer to the RCS and containment devices, fluid mixing and homogenization, fluid treatment to subsea infrastructure, gas venting, gas sampling, gas transfer, and other fluid handling operations at the seabed, in the water column, and on the surface.

In one embodiment of controlled venting during ascent, the accumulator of the SSTR is filled to a volume determined by the properties of the oil with live hydrocarbon at full depth. The inlet to the accumulator is then blocked and the SSTR ascends via crane. The gas entrained in the hydrocarbon fluid expands, pushing the piston down until it engages the bottom of the accumulator. The SSTR is then retrieved to surface, stopping at various points to allow further gas-liquid separation and to prevent liquid carryover with gas. The equipment is vented to a minimal ambient pressure, then the valves are closed to isolate the system for deck retrieval with minimal pressure buildup inside and minimal gas volume remaining within. The reduced on-deck volume allows for a simpler and safer fluid transfer operation and minimizes risk to personnel.

Figure 3:
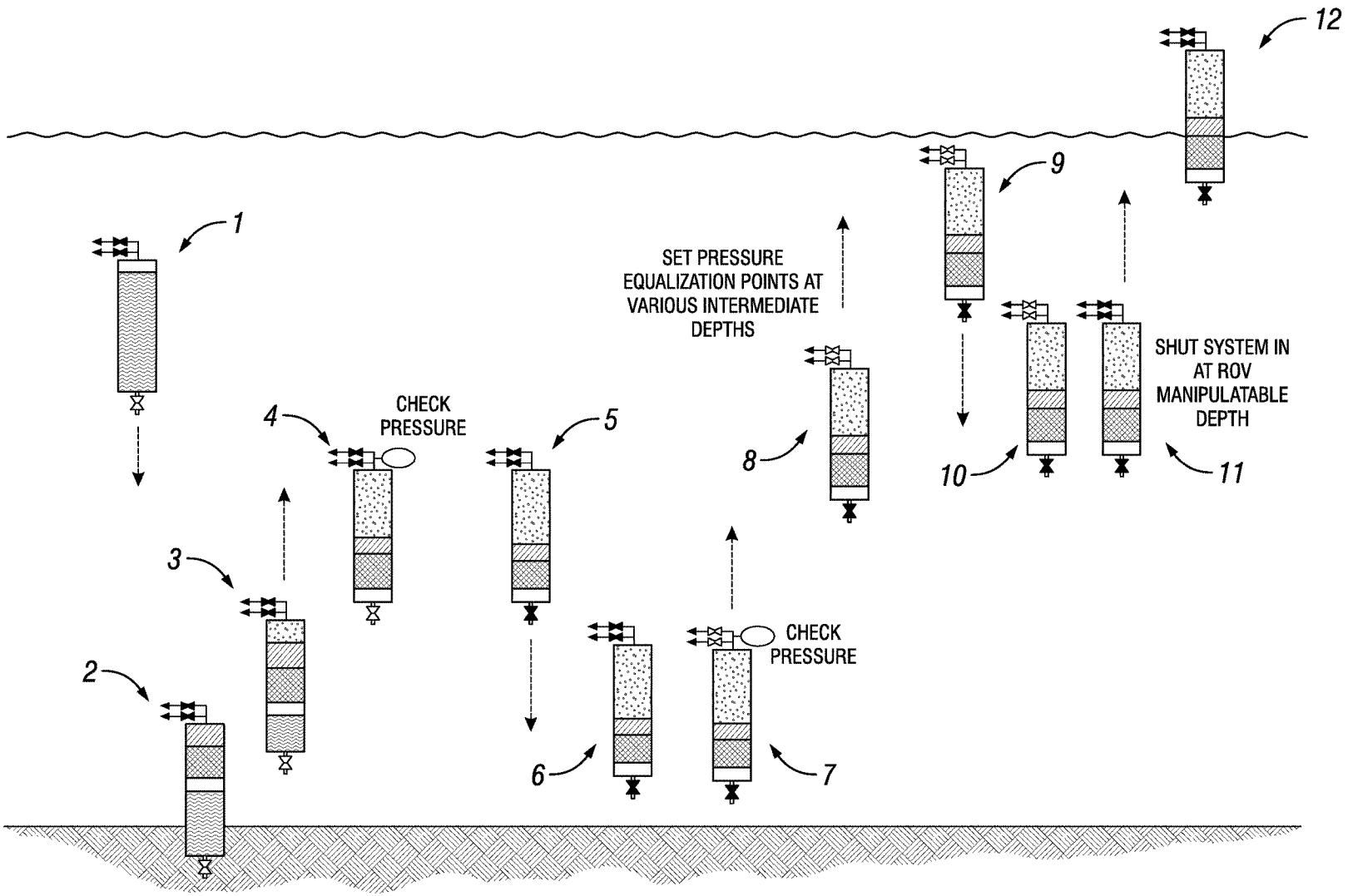
FIG. 3 illustrates one embodiment of the relative depths of the controlled venting scheme during ascent of the SSTR.

FIG. 3 illustrates one embodiment of the relative depths of the controlled venting scheme during ascent of the SSTR 1000. As shown in step one, SSTR 1000 is being deployed to its retrieval depth. During deployment, SSTR 1000 is filled with water and opened to ambient. As shown in the second step, SSTR 1000 is at retrieval depth and hydrocarbon filling occurs. After filling, all gas valves of SSTR 1000 are closed and the water drain valves below the piston are opened and ascent begins. As shown in the third step, SSTR 1000 is ascending to a pre-determined depth, based on the Gas Oil Ratio (GOR) of the hydrocarbon fluid and the volume of fluid input into the accumulator, where the piston will be at the bottom of its stroke in the accumulator. SSTR 1000 will be held at this depth for pressure equalization and the piston will be verified to have bottomed by checking the pressure on the accumulator as shown in step four. After the piston is verified to have bottomed, the valves below the piston will be closed in the fifth step. At this point each accumulator bottle will be "full." As shown in the sixth step, SSTR 1000 will descend to a hold point depth below the bottoming depth to enable valve operation without gas release. Once pressure has equalized at this depth, the check valves are opened on the gas vent hydraulic lines and SSTR 1000 will resume ascent to the surface as shown in step seven. As shown in step eight, during ascent, SSTR 1000 will stop at specific water depths for pressure equalization and venting. The hold depths and times for these equalization periods will vary based on water depth, and oil volume and composition. As shown in step nine, SSTR 1000 will ascend to the shallowest point in the ascent to a depth prior to the wave affected zone (WAZ) that allows optimal gas volume venting while preventing fluid carryover. As shown in step ten, SSTR 1000 will descend to depth where an ROV can manipulate the valve panel of the SSTR 1000 and close gas vent valves. As shown in the eleventh step, once all valves on SSTR 1000 are shut in, SSTR 1000 will ascend to surface and SSTR 1000 will be retrieved to deck in a controlled manner as shown in step twelve. Following deck recovery, SSTR 1000 accumulators will be evacuated into a treatment/storage/transfer location through the use of free-flow from the trapped fluids. When the pressure inside the accumulators equals the ambient pressure on deck, the accumulator cylinders can be emptied by pumping water into the bottom side of cylinder below piston.

The benefit of vented ascent is the ability to bring the hydrocarbon fluids to surface on deck at very low pressure (<2 atm over ambient) and with minimal gas. The minimal trapped pressure reduces the risk to personnel due to pressurized equipment. It also means that there is a smaller volume of flammable vapors present on deck during transfer operations, again reducing personnel risk on deck.

In another embodiment, an SSTR can also be retrieved on deck under pressure at larger volumes than a typical sample container of 10 L maximum. For example, in one embodiment, the SSTR can bring up to 208 gallons of fluid from seabed to surface under pressure. The volume amount is scalable based on size of, and quantity of, accumulator bottles.

In another embodiment, an SSTR can be used to transit the fluids from one seabed location to another, creating options for moving oil from one collection point or many separate collection points, as well as adding the ability to reinject collected fluids into existing subsea infrastructure. In addition, in one embodiment, the SSTR can collect fluids from multiple CTs in one accumulator bottle, and then transit the system to the next CT for collection, or transit the system to surface when the collection operation is complete. In one embodiment, an SSTR can also be used with chemical fluids instead of hydrocarbon fluids to enable chemical injection into subsea infrastructure.

In another embodiment, an SSTR may be utilized for large volume subsea sampling. In this embodiment, the SSTR accumulators can be sized such that the SSTR can accept a large volume from a wellstream. The factors limiting a collection from a wellstream are maximum allowable operating pressure (MAOP) of the SSTR, as well as accumulator sizing, and number of accumulators based on vessel lift capacity of the vessel responsible for deploying and recovering the SSTR. In this scenario, the RCS pump skid my not be necessary to flow the fluid from the collection point into the SSTR accumulator bottles depending on the ability to use the differential pressure between the fluid to be collected and the SSTR bottles as a drive force for inlet into the SSTR.

While the methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A subsea live hydrocarbon fluid retrieval system for retrieving live hydrocarbon fluid to a surface location, comprising:

a. a subsea storage and transfer rack (SSTR) including at least one accumulator having a piston therein;

b. at least one containment device installed on a seabed over a seabed location of live hydrocarbon fluids seeping from the seabed for collecting the live hydrocarbon fluids from the seabed;

c. a remotely operated vehicle collection skid having a pump for pumping a fill volume of the live hydrocarbon fluids from the at least one containment device to the at least one accumulator;

d. a first flying lead for connecting the at least one containment device to the remotely operated vehicle collection skid;

e. a second flying lead for connecting the SSTR to the remotely operated vehicle collection skid; and f. a means for controlling the fill volume of the collected live hydrocarbon fluids pumped to the at least one accumulator selected from the group consisting of a flow meter in the remotely operated vehicle collection skid for measuring fluid volume pumped, pump timing and counting pump strokes, such that an internal position of the piston in the at least one accumulator can be established when the SSTR is at the seabed location to allow control of gas venting operations based on the fluid volume and a gas/oil ratio and establishing a gas cap in the at least one accumulator during retrieval of the SSTR to the surface location.

2. The system of claim 1 wherein the at least one containment device comprises a single containment device installed on a seabed over a single location of live hydrocarbon fluids for collecting the live hydrocarbon fluids.

3. The system of claim 1 wherein the at least one containment device comprises a plurality of independent containment devices installed on a seabed over a plurality of locations of live hydrocarbon fluids for collecting the live hydrocarbon fluids.

4. The system of claim 1 wherein the subsea storage and transfer rack contains a chemical fluid to enable chemical injection into a subsea infrastructure.

5. The system of claim 1 wherein the at least one accumulator comprises a plurality of accumulators wherein the plurality of accumulators has a total volumetric capacity of from 400 liters to 3000 liters.

6. A subsea live hydrocarbon fluid retrieval method for retrieving live hydrocarbon fluid to a surface location, comprising:

a. installing at least one containment device on a seabed over at least one location of live hydrocarbon fluids seeping from the seabed;

b. collecting live hydrocarbon fluids in the at least one containment device;

c. using a subsea storage and transfer rack (SSTR) with a source pressure to transfer the collected live hydrocarbon fluids from the at least one containment device to a hydrocarbon fluid side of at least one accumulator, wherein the SSTR includes the at least one accumulator having a piston therein and wherein the at least one accumulator has the hydrocarbon fluid side on one side of the piston and a water side on another side of the piston;

d. monitoring and controlling a fill volume of the collected live hydrocarbon fluids transferred into the hydrocarbon fluid side in the at least one accumulator, allowing space in the hydrocarbon fluid side for a gas cap to form; and e. transiting the collected live hydrocarbon fluids to the surface location during which transit to the surface location, the collected live hydrocarbon fluids are allowed to degas to a desired extent and a gas cap is thereby established in the at least one accumulator wherein the transiting the collected live hydrocarbon fluids to the surface location comprises venting gas from the gas cap to depressurize the at least one accumulator as ambient pressure drops as the SSTR ascends.

7. The method of claim 6 further comprising using a remotely operated vehicle collection skid attached to a work class remotely operated vehicle to pump the collected live hydrocarbon fluids from the at least one containment device into the at least one accumulator of the SSTR through one or more hydraulic hoses.

8. The method of claim 6 wherein transiting the collected live hydrocarbon fluids comprises transiting the collected live hydrocarbon fluids for subsea reinjection.

9. The method of claim 6 wherein the at least one containment device on a seabed over at least one location of live hydrocarbon fluids seeping from the seabed comprises a single containment device installed on a seabed over a single location of live hydrocarbon fluids seeping from the seabed.

10. The method of claim 6 wherein the at least one containment device on a seabed over at least one location of live hydrocarbon fluids seeping from the seabed comprises a plurality of independent containment devices installed on a seabed over a plurality of locations of live hydrocarbon fluids seeping from the seabed.

11. The method of claim 6 wherein the at least one accumulator comprises a plurality of accumulators wherein the plurality of accumulators has a total volumetric capacity of from 400 liters to 3000 liters.

12. The method of claim 6 wherein during the transiting the collected live hydrocarbon fluids to the surface location, the piston in the at least one accumulator is moved by the expansion of gas in the collected live hydrocarbon fluids.

13. The method of claim 6 wherein the fill volume in the at least one accumulator is determined based on a gas oil ratio of the collected live hydrocarbon fluids and a depth of the at least one containment device on the seabed.

14. The method of claim 13 wherein the fill volume in the at least one accumulator is controlled using a means for measuring fluid volume pumped selected from the group consisting of pump timing, counting pump strokes, and measuring fluid volume using a flowmeter.

15. A subsea live hydrocarbon fluid retrieval method for retrieving live hydrocarbon fluid to a surface location, comprising:

a. providing a subsea storage and transfer rack (SSTR) including a plurality of gas valves, at least one accumulator having a piston therein and a hydrocarbon side on one side of the piston and a water side on another side of the piston, and a plurality of water drain valves located below the piston;

b. deploying the SSTR to a subsea retrieval depth wherein the at least one accumulator is filled with water and opened to ambient sea;

c. filling the hydrocarbon side of the at least one accumulator with live hydrocarbon fluids from a seabed at the subsea retrieval depth;

d. initiating ascent of the SSTR by closing the plurality of gas valves and opening the plurality of water drain valves;

e. ascending the SSTR to a pre-determined hold point depth where the piston is at a bottom in the at least one accumulator based on a gas oil ratio (GOR) of the live hydrocarbon fluids and a fill volume of the live hydrocarbon fluids input into the at least one accumulator;

f. closing the plurality of water drain valves when the at least one accumulator is full and a gas cap has been established in the at least one accumulator above the live hydrocarbon fluids on the hydrocarbon fluid side of the piston;

g. descending the SSTR to a deep hold point depth below the pre-determined hold point depth to enable operation of the plurality of gas valves without gas release to the ambient sea;

h. opening a plurality of gas vent valves to vent gas on ascent of the SSTR wherein gas vents through at least one check valve above the at least one accumulator, wherein the at least one check valve is used to maintain a pressure slightly above ambient pressure at depth to prevent sea water ingress into the at least one accumulator and wherein the at least one check valve is preset to operate at a differential pressure to control velocity of the vented gas and prevent release of oil through fluid carry-over; at a shallow hold point depth below a wave-affected zone, closing the plurality of gas vent valves;

i. monitoring fluid pressure and a volume of gas vented from the SSTR to determine whether conducting additional descents and ascents with manipulation of the plurality of gas vent valves from this depth are necessary to allow degassing of the fluid to a desired extent; and j. retrieving the SSTR at the surface location with the plurality of gas vent valves open.

16. The method of claim 15, further comprising allowing pressure inside the at least one accumulator to equalize with ambient pressure at the surface location; and emptying the at least one accumulator by pumping water into the water side of the at least one accumulator to displace hydrocarbons from the at least one accumulator into a tank for processing or disposal.

* * * * *